US008562411B2

(12) United States Patent
Irwin, Jr. et al.

(10) Patent No.: US 8,562,411 B2
(45) Date of Patent: Oct. 22, 2013

(54) ELECTRONIC GAMING DEVICES

(75) Inventors: Kenneth E. Irwin, Jr., Dawsonville, GA (US); Gary R. Streeter, Andover, MA (US)

(73) Assignee: Scientific Games International, Inc., Newark, DE (US)

( * ) Notice: Subject to any disclaimer, the term of this patent is extended or adjusted under 35 U.S.C. 154(b) by 1336 days.

(21) Appl. No.: 11/862,267

(22) Filed: Sep. 27, 2007

(65) Prior Publication Data

US 2008/0081686 A1 Apr. 3, 2008

Related U.S. Application Data

(60) Provisional application No. 60/847,800, filed on Sep. 28, 2006.

(51) Int. Cl.
*A63F 9/24* (2006.01)

(52) U.S. Cl.
USPC ..... 463/17; 463/29; 283/83; 273/148 R; 235/375

(58) Field of Classification Search
USPC ..... 463/17
See application file for complete search history.

(56) References Cited

U.S. PATENT DOCUMENTS

| | | | | | |
|---|---|---|---|---|---|
| 4,882,473 | A | * | 11/1989 | Bergeron et al. | 463/25 |
| 5,260,552 | A | * | 11/1993 | Colbert et al. | 235/482 |
| 5,310,997 | A | * | 5/1994 | Roach et al. | 235/375 |
| 5,499,816 | A | * | 3/1996 | Levy | 273/139 |
| 5,599,046 | A | * | 2/1997 | Behm et al. | 283/83 |
| 5,772,510 | A | * | 6/1998 | Roberts | 463/17 |
| 5,949,042 | A | * | 9/1999 | Dietz et al. | 235/375 |
| 5,980,385 | A | * | 11/1999 | Clapper, Jr. | 463/17 |
| 6,024,640 | A | * | 2/2000 | Walker et al. | 463/17 |
| 6,053,405 | A | | 4/2000 | Irwin et al. | |
| 6,110,044 | A | * | 8/2000 | Stern | 463/29 |
| 6,267,670 | B1 | * | 7/2001 | Walker et al. | 463/17 |
| 6,379,742 | B1 | * | 4/2002 | Behm et al. | 427/7 |
| 6,435,408 | B1 | * | 8/2002 | Irwin et al. | 235/441 |
| 6,491,215 | B1 | * | 12/2002 | Irwin et al. | 235/375 |
| 6,776,337 | B2 | * | 8/2004 | Irwin et al. | 235/441 |
| 6,875,105 | B1 | * | 4/2005 | Behm et al. | 463/17 |
| 6,913,534 | B2 | * | 7/2005 | DeFrees-Parrott et al. | 463/17 |
| 6,932,258 | B1 | * | 8/2005 | Roberts et al. | 225/103 |
| 2002/0109295 | A1 | * | 8/2002 | Browne et al. | 273/148 R |
| 2002/0183107 | A1 | * | 12/2002 | Wolfe | 463/17 |
| 2003/0042306 | A1 | * | 3/2003 | Irwin et al. | 235/441 |
| 2003/0199302 | A1 | * | 10/2003 | Weiss | 463/17 |

(Continued)

FOREIGN PATENT DOCUMENTS

| | | |
|---|---|---|
| GB | 2 377 389 | 1/2003 |
| WO | 2006/116501 A | 11/2006 |

OTHER PUBLICATIONS

PCT International Search Report and Written Opinion for PCT/US2007/079625, dated May 29, 2009.

*Primary Examiner* — Paul A D'Agostino
(74) *Attorney, Agent, or Firm* — Dority & Manning, P.A.

(57) ABSTRACT

An electron game machine is provided that may be used in association with standard or special type lottery tickets to enhance a lottery players game experience. The machine may be configure for single or plural play options and may be recharged for reuse. Game play data may be entered manually or automatically. Game machines may be manufactured as generic devices and programmed with game specific information as needed.

22 Claims, 3 Drawing Sheets

(56) References Cited

U.S. PATENT DOCUMENTS

| | | | | |
|---|---|---|---|---|
| 2003/0207708 | A1* | 11/2003 | Sadri et al. | 463/17 |
| 2004/0023711 | A1* | 2/2004 | Knapp | 463/17 |
| 2004/0053011 | A1* | 3/2004 | Behm et al. | 428/195 |
| 2004/0176158 | A1* | 9/2004 | Baldwin | 463/17 |
| 2005/0064925 | A1* | 3/2005 | Robb | 463/16 |
| 2005/0107153 | A1* | 5/2005 | Jubinville et al. | 463/18 |
| 2005/0156318 | A1* | 7/2005 | Douglas | 257/761 |
| 2006/0094491 | A1* | 5/2006 | Breslo | 463/17 |
| 2006/0094492 | A1 | 5/2006 | Wolfe | |

* cited by examiner

100

| Input A | Input B | NAND Output | NOR Output |
|---|---|---|---|
| L | L | H | H |
| L | H | H | L |
| H | L | H | L |
| H | H | L | L |

FIG. 1

110

Gravure Data

120

| PED | 0 | 1 | 2 | 3 | 4 | 5 | 6 | 7 | 8 |
|---|---|---|---|---|---|---|---|---|---|
| 0 | 0 | 1 | 2 | 3 | 4 | 5 | 6 | 7 | 8 |
| 1 | 1 | 2 | 3 | 4 | 5 | 6 | 7 | 8 | 9 |
| 2 | 2 | 3 | 4 | 5 | 6 | 7 | 8 | 9 | 10 |
| 3 | 3 | 4 | 5 | 6 | 7 | 8 | 9 | 10 | 11 |
| 4 | 4 | 5 | 6 | 7 | 8 | 9 | 10 | 11 | 12 |
| 5 | 5 | 6 | 7 | 8 | 9 | 10 | 11 | 12 | 13 |
| 6 | 6 | 7 | 8 | 9 | 10 | 11 | 12 | 13 | 14 |
| 7 | 7 | 8 | 9 | 10 | 11 | 12 | 13 | 14 | 15 |
| 8 | 8 | 9 | 10 | 11 | 12 | 13 | 14 | 15 | 0 |
| 9 | 9 | 10 | 11 | 12 | 13 | 14 | 15 | 0 | 1 |

130

FIG. 2

ELECTRONIC GAMING DEVICES

PRIORITY CLAIM

Applicant claims the benefit of prior filed provisional application No. 60/847,800 having a filing date of Sep. 28, 2006 and entitled "Electronic Gaming Device."

BACKGROUND OF THE INVENTION

This disclosure proposes multiple methodologies for making and playing lottery style portable gaming devices. Specifically, this application provides a secure methodology for creating and operating portable devices, allowing players to play sanctioned lottery games in a lively, digital, interactive format.

Lottery games have become a time honored method of raising revenue for state and federal governments the world over. Traditional scratch-off and on-line games have evolved over decades, supplying increasing revenue year after year. However, after decades of growth, the sales curves associated with traditional games seem to be flattening out. Consequently, both lotteries and their service providers (e.g., Scientific Games, GTech, Pollard Banknote, etc.) are presently searching for new forms of gaming.

Recently, electronic game cards have been added to the various lottery products available to the consumer. While, from a lottery perspective, these devices are the functional equivalent of an instant ticket, the consumer views them as an entirely different product—one that adds entertainment value to the game itself. Indeed, in the relatively short time that electronic game cards have been in the marketplace, they have shown surprisingly robust sales. However, these electronic game cards are relatively expensive to manufacture. This added expense creates poorer payouts and lower prize levels for the consumer, thereby possibly impacting long-term sales. Additionally, the electronic game card presents various logistical challenges. For example, in some game cards, prize payouts are programmed by placement of wire bonding during manufacturing. This method of programming creates numerous challenges in ensuring that each card is affixed with an encrypted lottery barcode that agrees with the card's prize outcome. This problem is especially burdensome when it is viewed that the electronic game cards must be assigned a pseudo-sequential serial number to be compatible with lottery validation systems.

Additionally, by programming prize values with variable wire bonding, each card can only be played once by a consumer, that is, multiple plays on the same card would all play out to the same prize value. This one-time-play limitation of existing electronic game cards has economic impact on the viability of the product, since all production costs must be recovered in the initial sale. Thus, these types of electronic game cards typically retail for $20 or more. Such a high retail price greatly reduces the potential market for these game cards.

In light of the noted disadvantages of existing electronic game cards alternative embodiments that have either logistical or economic advantages over the existing electronic game card are desired.

SUMMARY OF THE INVENTION

Objects and advantages of the invention will be set forth in part in the following description, or may be obvious from the description, or may be learned through practice of the invention. In view of the recognized features encountered in the prior art and addressed by the present subject matter, an improved apparatus and methodology has been provided to further enhance a lottery participants gaming experience through the development of one-time and multiple play electronic game machines.

In an exemplary configuration, a one-time-play electronic game machine is provided.

In one of their simpler forms, programmable electronic game machines are provided that may be programmed following assembly.

Another positive aspect of this type of device is that generic electronic game machines may be stockpiled for future use and programmed after an order for game machines is placed.

In accordance with aspects of certain embodiments of the present subject matter, methodologies are provided to simplify programming of electronic game machines.

In accordance with certain aspects of other embodiments of the present subject matter, methodologies have been developed to multiple play electronic game machines.

In accordance with yet additional aspects of further embodiments of the present subject matter, apparatus and accompanying methodologies have been developed to permit use of player-entered data.

According to yet still other aspects of additional embodiments of the present subject matter, apparatus and methodologies have been developed to provide ease of distribution of electronic game machines and related printed materials through non-secure delivery methods.

In accordance with yet still further aspects of still further embodiments of the present subject matter, methodologies have been developed to enable the an electronic game machine to become its own advertisement for the sponsoring lottery.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures).

Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 1 illustrates logical output resulting from various input signals to NAND and NOR devices as may be employed in certain embodiments in accordance with the present subject matter;

FIG. 2 illustrates in table form Gravure Data as may be associated with an electronic game machine and such data's association with Player Entered Data;

Figure 3:
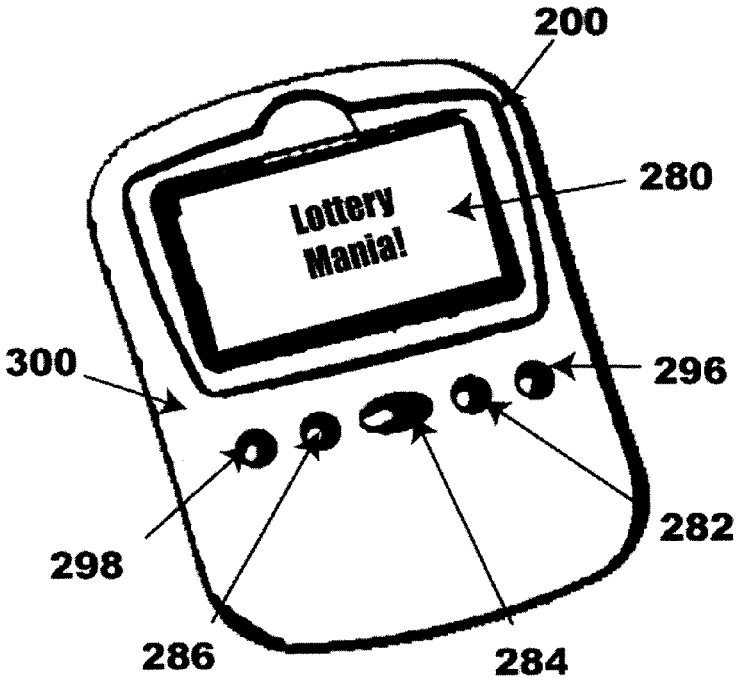
FIG. 3 illustrates a front oblique view of a game machine constructed in accordance with the present subject matter.

Repeat use of reference characters throughout the present specification and appended drawings is intended to represent same or analogous features or elements of the invention.

DETAILED DESCRIPTION

As discussed in the Summary of the Invention section, the present subject matter is particularly concerned with electronic game machines and, more particularly, to electronic game machines designed for either single or multiple play.

Selected combinations of aspects of the disclosed technology correspond to a plurality of different embodiments of the present invention. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function. Reference will now be made in detail to the presently preferred embodiments of the subject electronic gamming device.

A first embodiment of the present subject matter relates to a one-time-play electronic game machine. As will be explained further with respect to FIGS. 3-5, an electronic game machine constructed in accordance with the present subject matter will generally include a microprocessor, a memory, an input, and an output. Generally an output may correspond to a display device. One method of producing one-time-playable electronic game machines may correspond to reserving a small amount of programmable non-volatile memory on the microprocessor or a separate memory chip. In an exemplary embodiment, 4-bits of memory may be reserved. In such an embodiment of the present subject matter, the game machine's prize value may be determined by the contents of the non-volatile memory. Since the memory is programmable, this embodiment has the important advantage that it can be programmed after the machine is completely assembled. Such post assembly capability to program the game machines' prize amounts provides a number of advantages.

A first such advantage relates to an ability to stockpile generic game machines afforded through implementation of the present subject matter. Generic game machines may be constructed so as to be identical to one another and do not contain a predetermined final prize amount. Such generic configuration provides advantages over, for example, an electronic game card with variable wire bonding prize value determination, that must have their prize values set during the manufacturing process and therefore must be manufactured only after an order is placed to ensure the proper prize distribution.

A further positive aspect of the present subject matter resides in the fact that the microprocessor may be programmed to perform a self-check and generate an appropriate display result before any prize value has been programmed. Such self-check prior to programming provides functional testing of completed game machines. Those generic game machines passing their self-test may be provided with printed barcodes specifying the prize value that is to be assigned to the game machine. In an exemplary configuration, an affixed barcode may be scanned and the scanned information decrypted and then employed to program the machine. Such a programming sequence depending on reading data from an already affixed barcode reduces the chance for error significantly. In addition to reduced chances for error, such programming on demand eliminates post programming steps involving potting or otherwise obscuring portions of a game machine that must remain available for programming efforts including, for example, wire bonding sites required for hardwiring of a prize level.

In accordance with present technology, programming of electronic game machines may be achieved in a variety of ways. In accordance with one approach, exposed printed circuit pads or connectors that readily mate to an automated programming device may be used. As would be apparent to those of ordinary skill in the art, in order for the machine to remain secure against possible pick-out, that is, surreptitious discovery of the data representing the prize value. Any exposed programming pins must not reveal the memory contents after the programming is completed. Further, the use of One Time Programmable (OTP) memories would preclude lottery cheats from 'upgrading' the prize values.

In a second exemplary embodiment, prize value information may be provided to the electronic game machine by way of an external logic chip. In accordance with this second exemplary embodiment of producing a one-time-playable electronic game machine, an external logic chip corresponding to, for example, NAND, NOR, or AND gates may be used to set the prize value. In this exemplary embodiment, the prize value would be determined by the logic functions of the external logic chip. For example as may be seen with reference to FIG. 1, a NAND gate (chip) would produce different outcomes than a NOR chip based on the same input levels for representative inputs "A" and "B".

In such an embodiment a microprocessor contained within the game machine would be programmed to query the external logic gates to determine their functionality and type. The arrangement of the gates would then equate to a predetermined prize value. For example, eight NANDs may equal the lowest tier, eight NORs the next higher tier, four NANDs and four NORs the next highest tier, four NORs and four ANDs the next highest tier, and so forth. In this particular arrangement, the external gates may be susceptible to pick-out so that it may be necessary to cover both the gates and the microprocessor in a common potting material. In order to minimize the size of the gated electronic game machine, very small footprint packages, for example, Small Outline Integrated Circuits, SOIC, are preferably employed.

By utilizing discrete logic chips to determine the prize amount, the electronic game machine uses dynamic data to determine the prize value. With the use of dynamic data, the game machine's error rate is greatly reduced over a wire bonded prize system so that a functional chip must be detected and respond a priori to the microprocessor's query. In other words, it is highly unlikely that a dynamic system would fail in a manner to erroneously produce a different logic set. In contrast, a variable wire bonded prize system is more susceptible to errors caused by, for example, broken wires. Additionally, a discrete logic chip system for prize determination lends itself to automated assembly, i.e., automated chip placement devices can be easily programmed to vary a chip placed on a given Printed Circuit Board (PCB). In contrast, wire bonding machines are typically set up to perform the same wire bonding operation repeatedly.

In accordance with yet another exemplary embodiment of the present technology, a One Time Play (OTP) electronic game machine may be produced using one or more external resistance values to set the prize values. Like the external logic chip embodiment described above, these external resistance values may take the form of discrete components mounted external to the microprocessor. On boot-up the microprocessor measures the external resistance by any one of a variety of well-known methods and uses the resultant value to determine the final prize value. As with the logic gates previously discussed, it may be necessary to cover both the resistors and the microprocessor in a common potting material to avoid pick-out of the prize value.

This method has the advantage of being very inexpensive to implement as well as lending itself to automated assembly. Inexpensive resistors are readily available with a ±5% tolerance. Additionally, resistors and other electronics tend to be unstable over a large temperature range. To compensate for these imprecisions, the circuitry for resistive sensing OTP electronic game machines may be designed to process data correctly with a ±20% range of programming resistances. In alternative embodiments, the physical presence or absence of resistors can also be used to produce a binary coded input to the game machine.

In accordance with further embodiments of the present technology, a OTP electronic game machine may be created using one or more external capacitors to set the prize values. In such a configuration, the value of external capacitors would generate a microprocessor measurable quantity, for example, a time delay, which equates to an a priori prize value for the game's conclusion. Of course, both Resistance and Capacitance (RC) values can be combined to produce another measurable quantity, for example, a frequency. Like the logic gates above, it is necessary to cover both the capacitors and the microprocessor in a common potting material. Similar to resistance and logic chips, the capacitance method also has the advantage of being very inexpensive to implement as well as lending itself to automated assembly.

Further, in accordance with yet other embodiments of the present technology, a OTP electronic game machine may be created using one or more external inductors to set the prize values. In such a configuration the value of external inductors would generate a microprocessor measurable quantity, for example, a time delay, which equates to an a priori prize value for the game's conclusion. Like the logic gates above, it is necessary to cover both the inductor and the microprocessor in a common potting material. Similar to resistance and logic chips, the inductance method also has the advantage of being very inexpensive to implement as well as lending itself to automated assembly.

In accordance with yet further embodiments of the present technology and in a manner similar to the previously noted embodiment relating to the physical presence or absence of resistors, narrow printed circuit traces could be trimmed by laser etching techniques at virtually any point in the manufacturing process to provide data input for an electronic game machine. For example, a small opening in the housing would allow laser access. Once the circuitry has been cut, a drop of potting compound is added and the opening covered with a small sticker or label. Of course laser trimming could be employed with components as well as interconnections. For example, thin film or thick film resistors could be cut or their value adjusted by laser. The cutting technique does not need to be limited to lasers and such options as sand blasting, saw blades, grinding stones, and sharp cutting instruments could also be used. In a similar manner, fusible links could be opened by selectively passing appropriate currents through the link. The presence of such a link could indicate a logic "1" while the link's absence would be equivalent to logic "0." As in the case of cut circuits, fusible links could be opened and potted at virtually any point in the manufacturing process.

Further in accordance with present technology, as well as cutting existing circuits, connections or components could be added to a game machine. For example an opening in the housing might expose printed circuit pads that could be wire bonded and potted. Small inexpensive two pin connectors could accept jumpers, resistors, diodes, or any other type of component whose presence, absence, or electrical characteristics set the game machine prize level. These parts could also be added and potted at virtually any point in the manufacturing process.

Yet another exemplary embodiment of the present technology is directed to multiple play electronic game machines. In accordance with the present disclosure, two basic types of multi-play machines have been provided. A first such multiple play game machine contains a programmable memory that may be updated by any of several methods to be discussed further herein below. As will be seen from later discussion, some of these update methodologies involve manual entry of data while others provide automatic data entry. Based on the specific game design, a memory associated with the multiple play game machine may be volatile or non-volatile.

Another embodiment of multiple play electronic game machines constructed in accordance with present technology provides a connector which interfaces with an external device. The external device is configured to contain prize information so that programmable memory is not necessarily involved, although in certain instances such memory may, never-the-less, be included within the electronic game machine. Alternative embodiments of electronic game machines that may be utilized as multiple play devices are discussed further herein below.

A first such alternative embodiment to one-time-playable (OTP) electronic game machines corresponds to a game machine design that has no preprogrammed prize value. With such a multiple play machine, a player may manually enter information, obtained from standard or electronic game machine specific scratch-off lottery tickets, into these generic game machines. The game machine's microprocessor decodes the information to determine what prize must be won by the end of the game. After playing the game, the consumer simply hands the scratch-off ticket used to activate the game to the lottery retailer and the ticket is validated in the usual matter. Alternatively, a special on-line ticket may be printed at the time of purchase with an activation code printed in a human and/or a machine-readable format.

In this manner a generic lottery game machine could be introduced into an existing lottery infrastructure without making any changes to the validation or distribution systems. Generic lottery game machines do not require any special security measures because the game machines are generic in design, with no cognizance of any a priori prize outcome, that is, it is the information entered from the scratch-off or on-line ticket that determines the prize award, not the generic game software itself. Since the security is derived from the scratch-off ticket or on-line system, the adoption of generic lottery machine games will allow the lottery to offer new style games while not forcing it to accept or review new security processes. The lottery can continue to rely upon time hardened security procedures that have evolved over decades of practice.

Another advantage inherent in this embodiment of the present technology is the ease of distribution. Since there are no special security precautions required, the generic lottery game machines could be made available to the consumer through non-secure means. The game machines could be provided free of charge, since funding would be realized through the sale of the associated lottery tickets, not by the sale of the game machines themselves. In fact, the generic game machines could be configured to allow free play with random outcomes if no information from a scratch-off or on-line lottery ticket is entered at the start of a new game. This possibility may enable wider distribution of the generic game applications, in essence, allowing the game to become its own advertisement for the lottery sponsoring it.

As those of ordinary skill in the art will appreciate, there is a cost to producing generic game machines. However, when it is realized that the existing electronic game machines have a cost associated with both software and hardware development for a one-time-play experience, it becomes apparent that the costs associated with generic game machine development become less significant because the costs can be amortized over multiple purchases. The greatly reduced cost-per-play allows for the prize values and payouts of the generic lottery game machines to more closely resemble that of traditional scratch-off tickets. Furthermore, the cost of such machines may be subsidized by advertising contained within the microprocessor's memory and displayed at various times throughout game play.

As an enhancement to the multiple play electronic game machine embodiment, generic multiple play game machines may be configured so that additional games may be loaded by the retailer. In other words, the machines would be sold to the player preloaded with one game. When the machine is presented to the retailer for validation, he or she could offer the player the ability to try again by purchasing another game for the same game machine. These additional games would only be loaded and activated by the lottery retailer. These machines are essentially the same as 'Player Entered Data' machines except the data may be entered by an automated or semi-automated means. Such automated or semi-automated means may correspond to a number of possibilities as described hereinafter.

An infrared (IR) transmitter/receiver (transceiver) is one inexpensive mechanism that may be employed to load additional plays onto a multiple-play game machine. In such an embodiment, the retailer would enter the additional purchase on his lottery terminal that, in turn, would actuate an IR transceiver to pass additional gaming information to the machine.

Radio frequency coupling is yet another of many possible methods that could be employed to load additional plays into a game machine. The advent of Radio Frequency Identification (RFID) chips clearly demonstrates that low cost integrated circuits can be used to transmit and receive data via an RF link over distances ranging from a few inches to a few feet. With the addition of an RFID-like chip, a generic game machine acquires the ability to accept prize level and even game type uploads from a lottery terminal equipped with an RF reader/writer. Even wireless (non-contact) programmable game machines retain stringent security safeguards. It is not adequate, for example, to simply download a new prize code to the game machine; the transaction must also be mirrored in the lottery's host computer. In addition, the player would have to present his receipt, that is, an online ticket, to the lottery retailer to claim his prize.

A less complex, and, therefore, potentially less expensive, method to transfer information to a programmable game machine is via a direct (or DC) connection. As an example, consider a retailer lottery terminal outfitted with a special connector. This connector may be designed to mate with a matching connector built into the programmable game machine. The player would present his game machine to the lottery retailer and upon payment of the appropriate fee, the retailer terminal would send the appropriate information to the game machine via the wired connection. Despite the fact that clever cheats may discover the technique used to program the game card, security remains high since the online receipt is still required to claim any prize. The game card connector can be virtually cost free if designed, for example, as traces on the printed circuit board to form an edge card connector.

In yet another configuration for data transfer to the game machine, any of a variety of well-known methods could be used to capacitively couple data into the game machine. As an example, consider two discrete frequencies the first representing a logic level 0 and the other representing a logic level 1. A special interface device would accept serial digital data from the lottery terminal and convert it to the appropriate AC signals to program the game machine's prize level. Capacitive coupling has the advantage that no game machine connector is available for the lottery cheat's experimentation thereby making the task of tampering with the game machine a bit more difficult.

Still further, a game machine may be fitted with an inexpensive 'swipe' type barcode reader. A barcode indicating prize level would be printed on a lottery ticket. When the game machine reads the barcode, the prize outcome is stored in memory. This type of ticket can be protected by pull tabs or latex, or special packaging.

Unlike the previous exemplary embodiments, which store the prize level in game machine memory, external hardware may also be used to store the prize level in a device external to the game machine, which device is interrogated by the game machine. There are many possible types of these devices.

One example of an 'external hardware' prize determining element is an Electronic Lottery Ticket (ELT) corresponding to conductive ink patterns printed on a standard lottery ticket machine board substrate using the Gravure or Flexo process. In this exemplary embodiment of the present technology, printed ink patterns are used to directly input a binary code to the game machine via a special purpose connector. As in the case of the Player Entered Data (PED) embodiment discussed herein above, the consumer would simply hand a lottery retailer the ELT used to program the game outcome and the ticket would be validated in the usual matter. ELTs printed with the Gravure method have the disadvantage that an identical group of tickets is printed every time the Gravure cylinder makes a complete revolution. These tickets must be cut apart, some tickets discarded, and the remainder shuffled in order to insure the correct prize structure is created. In addition, the final product must be specially packaged to prevent pickout by lottery cheats.

Identical conductive ink ELTs printed with the Gravure method can be individually trimmed after printing to create any desired prize level. A variety of suitable methods including laser, mechanical knives, and imaged solvents exist to perform the cutting operation. Such ELTs have the advantage that they do not have to be cut and shuffled, nor do tickets have to be discarded in order to create the desired prize structure. On the other hand, the previously mentioned problem of pick-out still exists and special packaging or other anti-tamper technique is required. The use of inkjet imaged conductive ink also provides the ability to create any desired prize level on each ticket. As in the previous two instances, special steps may be required to prevent pick-out.

If the Gravure process is used to print conductive ink patterns on two or more edges of the ELT, each with a different prize level code, an ELT that requires no special packaging or other special security precautions can be created. For example, assume the ticket contains two conductive ink patterns, one a high tier winner and one a low tier or losing prize. An imaged pointer hidden beneath scratch-off latex indicates which of the two patterns is inserted into the game machine. A lottery cheat might be able to determine what the two prize levels are, but he would not know which the actual legitimate prize was without scratching the latex from above the pointer, thereby invalidating the ticket. These tickets would thus not require special packaging to prevent pick-out and the ticket security is guaranteed by the time tested security procedures that have evolved over decades of practice.

In accordance with the present technology, an additional exemplary embodiment corresponds to a combination Gravure and PED ticket. In this case, the prize value of the ticket is determined by both the Gravure printed conductive ink and an imaged player-entered digit. As illustrated in chart 110 of FIG. 2, for example, assume there are 3 bits of Gravure data and 10 digits of PED available. In the example shown, Gravure data of 4, illustrated in column 120, could correspond to a final prize value of 4 through 13. Until a PED value of 6, illustrated in row 130, is entered, the game machine does not know the value. If a PED of 6 is entered, the prize value is known to be 10. The PED can be hidden beneath scratch-off latex or beneath a pull-tab style ticket. This style of ticket would not need to be specially packaged to prevent pick-out.

Electronic components including memory chips, microprocessor chips, and/or virtually any discrete component(s) can be mounted to a substrate containing electrical contacts and subsequently used as a ticket that may then be plugged into an electronic game machine in accordance with present technology to set the prize level. A variety of protection techniques are possible including, but not limited to, special packaging, pull tabs which activate the machine, and PED information hidden beneath latex.

Figure 4:
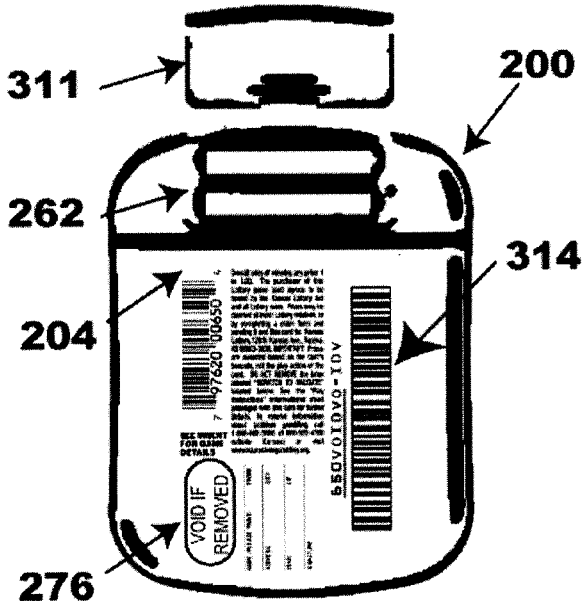
FIG. 4 illustrates a reverse or rear view of a game machine and particularly illustrates incorporated scratch off and barcode areas.

In accordance with present technology, more specific examples of exemplary embodiments of the present technology are presented herein below. With reference to FIGS. 3 and 4, there is illustrated an exemplary embodiment of a One-Time-Play (OTP) game machine constructed in accordance with the present subject matter. For purposes of this description, the embodiment illustrated in FIGS. 3-4 is described in the context of a lottery application, although as previously pointed out, a similar machine, or the same machine, may be used for coupon and recreational games without actually entering lottery supplied data.

Specifically to illustrate some of the system concepts and components of the system, a game system is described that may be play like a conventional instant lottery ticket game that utilizes an electronic game device 200 as a player activated Electronic Gaming Machine (EGM) in combination with a back label formatted as an instant lottery ticket backing. Preferably, player activated EGM 200, is a relatively small, inexpensive electronic device, which may be configured for single or multiple use.

In accordance with the exemplary embodiment illustrated in FIGS. 3-4, the electronic game machine (EGM) 200 includes, as seen in FIG. 4, an instant type lottery ticket back surface 204 that may be affixed to the back of EGM 200. In one mode in which the system can operate, a player would purchase one or more of the EGMs 200, remove wrapping (not shown), actuate the EGM by pressing button 284 (FIG. 4) on the front surface of EGM 200, and play a computer type game on the EGM 200 in which the outcome or prize value is predetermined by information contained in the EGM 200.

Figure 5:
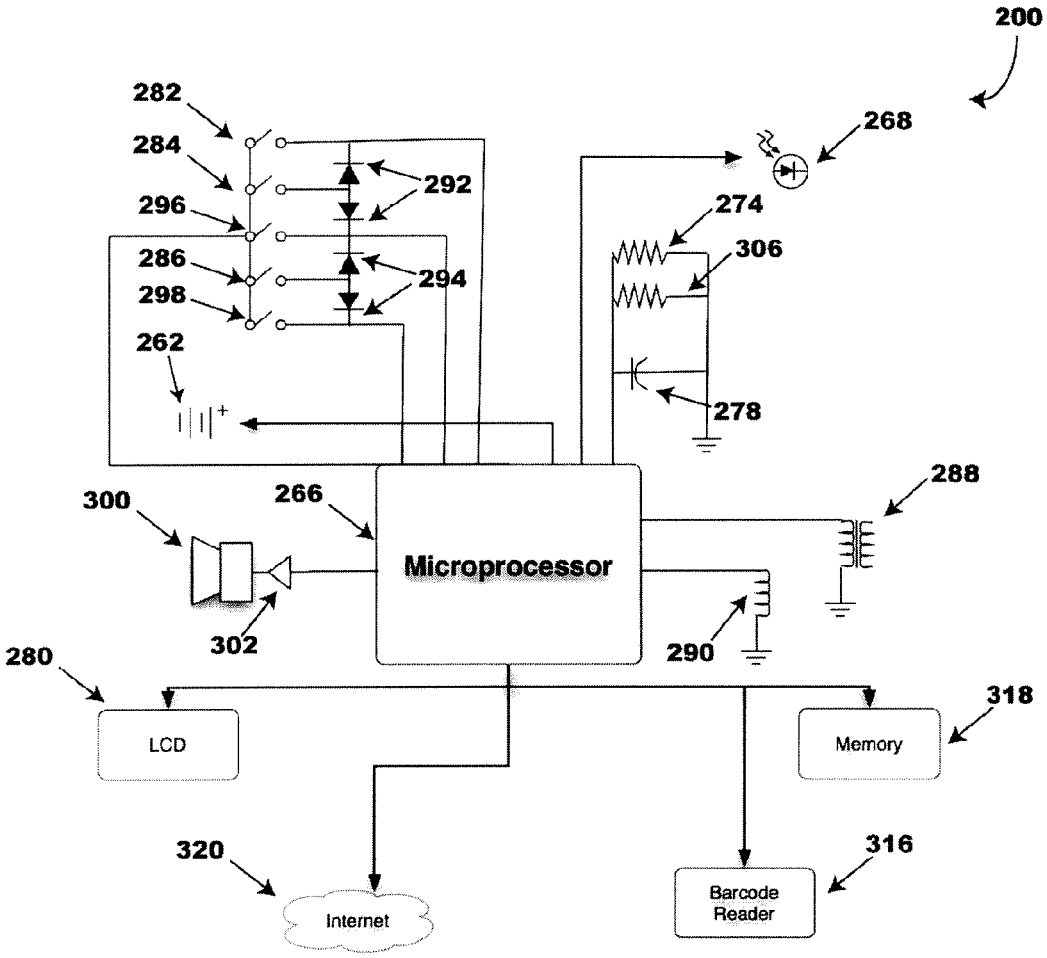
FIG. 5 illustrates an exemplary schematic diagram representing functional features of an exemplary game machine constructed in accordance with the present subject matter.

When the player first actuates EGM 200, by pressing button 284, the device will automatically inform the player, via Liquid Crystal Display (LCD) screen 280 and speaker 300 that this is the first time it has been actuated and how many credits the player has to play whatever games are preprogrammed into, for example, EGM 200's Read Only Memory (ROM) that may be integrated into its microprocessor 266 (FIG. 5).

FIG. 5 illustrates in schematic form an exemplary architecture for EGM 200. In this example configuration, EGM 200 includes a microprocessor 266 and is associated with a set of interface components as may be employed for normal operation microprocessor 266 and to obtain electronic signatures for prize values. Exemplary EGM 200 components employed for normal operation, and therefore will generally not vary from embodiment to embodiment, include, but are not limited to, battery 262, speaker 300 with associated amplifier and Pulse Width Modulator (PWM) 302, LCD screen 280, and switches 282, 284, 286, 296, and 298.

Specialized components that may be required for operation with a particular embodiment, and therefore may vary from embodiment to embodiment, include, but are not limited to, Infrared (IR) receptor diode 268, resistors 274 and 306, capacitor 278, internal inductor 290, inductive antenna 288, programmable memory 318, barcode reader 316, and external Internet/PC interface 320. Of the specialized components, resistors 274 and 306, capacitor 278, internal inductor 290, and programmable memory 318 would typically be used in One Time Playable (OTP) EGM 200 units. The IR receptor diode 268, inductive antenna 288, external Internet/PC interface 320, programmable memory 318, and barcode reader 316 would be employed for EGM 200 units that could be recharged, that is, where the EGM 200 is returned to the point of sale and for an additional fee, more game play can be added.

Specific exemplary configuration of electronic game machines in accordance with the present subject matter will now be described with respect to an exemplary OTP EGM 200 and a rechargeable, or multiple play EGM 200 unit. It should be appreciated by those of ordinary skill in the art, however, that while particular aspects of the subject EGM 200, are presented, other aspects of other embodiments including, but not limited to, electrical contacts or signal transmission arrangements can be used such as capacitive, inductive, RF or other wireless methods as previously mentioned. In all cases, EGM 200 will play out to the information provided by the components (e.g., programmable memory 318) which may be configured to store a wide variety of data such as, but not limited to: the type of game to be played; the predetermined prize level of the game; the status of the lottery barcode 314; as well as other game or ticket parameters as might be required for a specific game or games.

In accordance with this exemplary embodiment, back label 204's lottery barcode 314 will uniquely identify the EGM 200 unit to a lottery instant ticket type validation system, allowing the EGM 200 to be redeemed for the a priori prize vale at any time. As is typical during the instant ticket validation process, the retailer, that is, the person attempting to validate the ticket for a cash prize, must enter information that would have been hidden from normal view. In the case of OTP EGM 200 units, this information would typically be three decimal digits that would be hidden under a void if removed scratch-off area 276.

In other words, when redeeming the unit for a prize, the retailer would scratch off the void if removed area 276 to obtain the necessary decimal code to validate the EGM 200 unit. Since the scratch off coating can only be removed once and the scratch off coating 276 is labeled "VOID IF REMOVED", the requirement that the retailer enter the information hidden under the scratch-off area effectively prevents the retailer from plucking winning EGM 200 units from a lot of unsold units. For multiple play or refillable units, the added information would be printed on a receipt when additional games were added. During redemption, the consumer would present both the unit and associated lottery barcode 314 along with the receipt for payment.

As an example of the operation of EGM 200 operating as an OTP unit, internal programmable memory 318, when supplied with a predetermined prize value, provides microprocessor 266 with electronic signatures that may encode different possible prize levels associated with each of the different game types if a binary encoding technique is employed. In one of the operations of this particular embodiment, microprocessor 266 queries external memory 318 for the prize level. This prize level can be stored in as few as three or four bits. These data bits can be stored in Flash memory, but significant cost savings may be achieved by using narrow printed circuit traces that are trimmed by, for example, laser etching techniques as previously discussed herein above. Further, as also previously discussed, laser trimming could be employed with various other components as well as interconnections. For example, thin film or thick film resistors could be cut or their value adjusted by laser. Further, the cutting technique employed does not need to be limited to lasers and such options as sand blasting, saw blades, grinding stones, and sharp cutting instruments could also be used.

In an alternative multiple play embodiment in accordance with the present subject matter, additional games may be loaded into the electronic game machine EGM 200 by the retailer. One such method would be to supply the retailer with an IR transmitter attached to his lottery terminal. In this configuration, programmable memory 318 would be rewritable and would receive IR transmission via its IR sensitive diode 268 and microprocessor 266. When the player return the unit to the retailer for a recharge (i.e., adding more games) and paid the appropriate fees, the lottery terminal would transmit a series of IR pulses that equated to the recharged game prize value to EGM 200. EGM 200 would receive the IR pulse train via its IR receiver 268, and store the new prize value in programmable memory 318 for future play. At the same time, the player would be handed a receipt with the new three decimal digit validation code associated with the new prize value.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A portable electronic game machine, comprising:
a microprocessor;
at least one data entry device;
a display device; and
a game data source corresponding to a lottery ticket purchased by a player, wherein the game data source is separate from the electronic game machine,
wherein the game data source is configured to supply data for entry by the data entry device to be processed by the microprocessor, wherein the microprocessor enables a user to play a computer type game on the electronic game machine and the type of game to be played is supplied by the game data source and wherein the microprocessor is configured to process game play results based on prize data supplied by the game data source, wherein the electronic game machine lacks preprogrammed prize data, and to display the results on the display device.

2. An electronic game machine as in claim 1, wherein the at least one data entry device comprises at least one manual entry button.

3. An electronic game machine as in claim 2, wherein the game data source comprises a scratch-off type lottery ticket.

4. An electronic game machine as in claim 2, wherein the game data source comprises a lottery terminal printed receipt type lottery ticket.

5. An electronic game machine as in claim 1, wherein the at least one data entry device comprises an external data reading device and wherein the game data source comprises an external device containing readable data.

6. An electronic game machine as in claim 5, wherein the at least one data entry device comprises a barcode reader.

7. An electronic game machine as in claim 5, wherein the at least one data entry device comprises an infrared receiver.

8. An electronic game machine as in claim 5, wherein the at least one data entry device comprises a radio frequency receiver.

9. An electronic game machine as in claim 5, wherein the at least one data entry device comprises an electrical connector.

10. An electronic game machine as in claim 5, wherein the game data source comprises a printed barcode.

11. An electronic game machine as in claim 5, wherein the game data source comprises an electrical component.

12. An electronic game machine as in claim 11, wherein the game data source comprises a resistor.

13. An electronic game machine as in claim 11, wherein the game data source comprises a capacitor.

14. An electronic game machine as in claim 11, wherein the game data source comprises an inductor.

15. An electronic game machine as in claim 5, wherein the game data source comprises a radio frequency transmission.

16. An electronic game machine as in claim 3, wherein the game data source comprises a scratch-off type lottery ticket including at least two game data selections and wherein the scratch-off portion obscures data related to the game data selection to be used.

17. An electronic game machine as in claim 1, wherein the microprocessor is further programmed for free game play that produces random outcomes that are independent of data from the game data source.

18. An electronic game machine as in claim 1, further comprising: a memory, wherein the memory is configured to store data from the game data source.

19. An electronic game machine as in claim 18, further comprising: a network interface, wherein the memory is configured to store data received from a network.

20. An electronic game machine as in claim 19, wherein the network is the Internet.

21. An electronic game machine as in claim 18, wherein the memory is configured to store data for a plurality of games.

22. An electronic game machine as in claim 18, wherein the memory is re-writable.

* * * * *